US006273058B1

(12) United States Patent
Wagner

(10) Patent No.: US 6,273,058 B1
(45) Date of Patent: Aug. 14, 2001

(54) DECELERATOR DEVICE MOUNTED IN THE EXHAUST GAS CIRCUIT OF A VEHICLE EQUIPPED WITH A COMBUSTION ENGINE

(75) Inventor: Pierre-André Wagner, Mulhouse (FR)

(73) Assignee: Fowa le Frein Moteur S. A., Wittenheim (FR)

( * ) Notice: Subject to any disclaimer, the term of this patent is extended or adjusted under 35 U.S.C. 154(b) by 0 days.

(21) Appl. No.: 09/446,271

(22) PCT Filed: Apr. 22, 1999

(86) PCT No.: PCT/FR99/00966

§ 371 Date: Dec. 20, 1999

§ 102(e) Date: Dec. 20, 1999

(87) PCT Pub. No.: WO99/54612

PCT Pub. Date: Oct. 28, 1999

(30) Foreign Application Priority Data

Apr. 22, 1998 (FR) ..... 98 05211

(51) Int. Cl.[7] ..... F02D 9/06

(52) U.S. Cl. ..... 123/323; 60/324; 188/273; 251/214

(58) Field of Search ..... 123/323; 60/324; 188/273; 251/214

(56) References Cited

U.S. PATENT DOCUMENTS 4,682,674 7/1987 Schmidt ..... 188/273
4,750,459 6/1988 Schmidt ..... 123/323
5,372,109 * 12/1994 Thompson et al. ..... 60/324 X
5,503,367 4/1996 Thompson et al. ..... 251/214

FOREIGN PATENT DOCUMENTS 428318 7/1967 (CH) .
4116371 11/1992 (DE) .
2307718 6/1997 (GB) .

* cited by examiner

*Primary Examiner*—Tony M. Argenbright
(74) *Attorney, Agent, or Firm*—Davis & Bujold, P.L.L.C.

(57) ABSTRACT

A decelerator device obtains constant and maximal decelerating power includes by controlling the gas pressure upstream of the valve by balancing the efforts at the pressure-relief valve. The decelerator device (1) includes a balancing device (20) incorporated in the gate (2) body (4) and has a leakage conduit (21) controlled by a calibrated check valve (22). When the valve (7) is closed and, based on a counter-pressure threshold predetermined by the calibration of the compression spring (27) provided at the check valve (22) rear, the latter is lifted from its seat (25) and communicates the channel (5) upstream of the valve (7) with the leakage duct (21) generating an exhaust gas leakage. Beyond the threshold, the calibrated check valve (22) remains open, thereby ensuring constant and maximal counter-pressure whatever the engine speed. The invention is applicable to combustion engine vehicles and in particular industrial vehicles.

20 Claims, 5 Drawing Sheets

Figure 1:
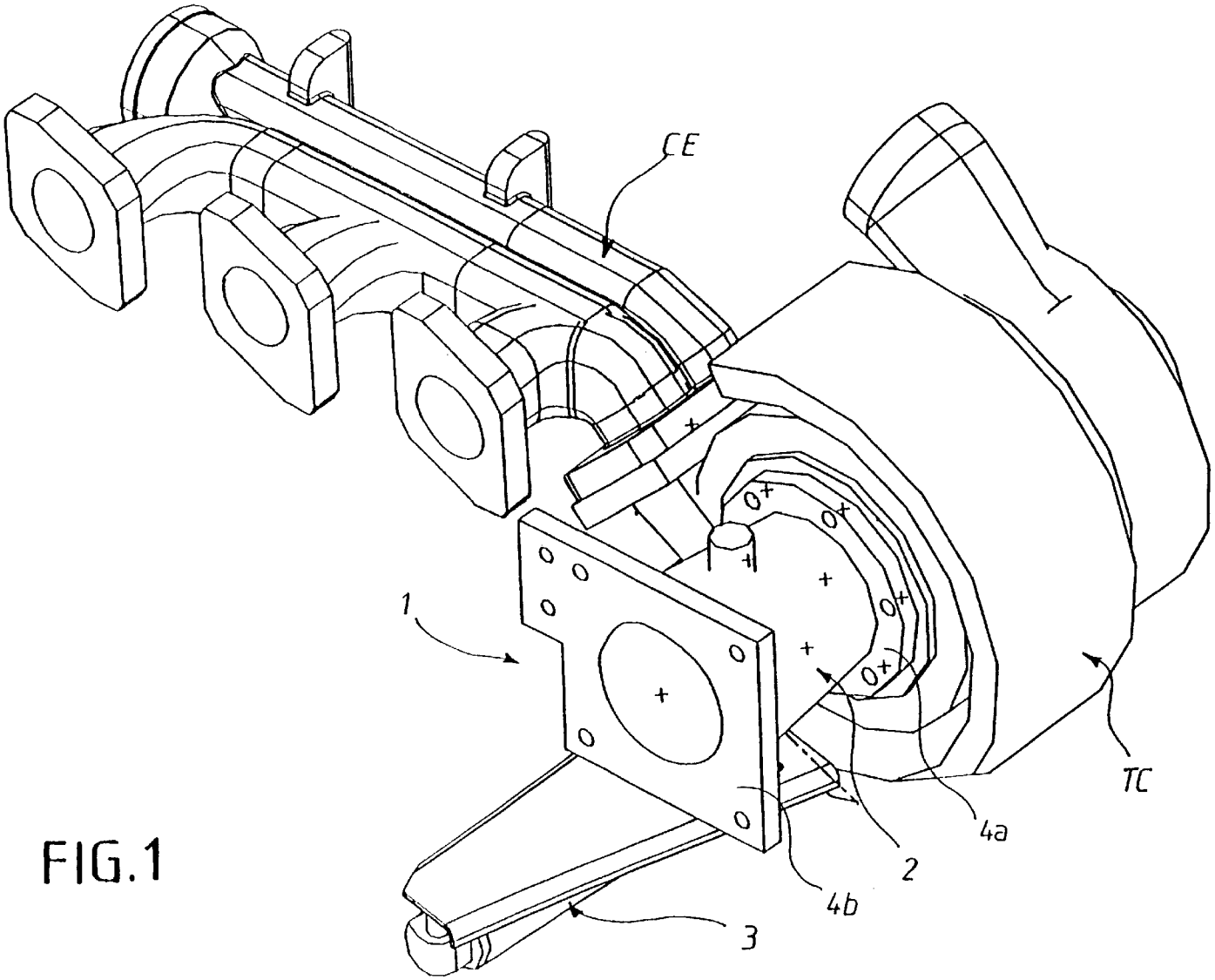

DECELERATOR DEVICE MOUNTED IN THE EXHAUST GAS CIRCUIT OF A VEHICLE EQUIPPED WITH A COMBUSTION ENGINE

The present invention relates to a decelerator device mounted in the exhaust gas circuit of a vehicle equipped with a combustion engine, comprising at least one valve provided with a body defining a channel and a movable shutter arranged at right angles in said channel and coupled to a drive shaft, and means of controlling this shutter comprising a device for balancing the back-pressure exerted by the shutter on the gas, this balancing device being designed to go into action when the shutter is in the closed position and when a predetermined back-pressure threshold is reached and to open an outlet pipe as soon as the back-pressure reaches said threshold, and to keep it open beyond said threshold whatever the engine's speed, so as to create a suitable exhaust gas leak rate, the balancing device comprising a calibrated flap-valve arranged in said outlet pipe and a compression spring arranged at the rear of said calibrated flap-valve, this spring being calibrated to said threshold value.

This type of decelerator is well known, particularly in the field of industrial vehicles equipped with a combustion engine. Taking into account their high inertia, in addition to their own braking system, these vehicles require a decelerator device housed in the exhaust gas circuit, preferably between the engine and the silencer, and generally mounted on the outlet side of the turbocompressor fed by the exhaust head. It is usually controlled by a pedal activated by the driver's left foot to prevent the latter from disengaging the clutch at the same time. This decelerator device makes it possible to generate a back-pressure in the exhaust circuit. This back-pressure is high or low depending on the position of the shutter and its degree of opening. It has the effect of slowing down the engine and therefore provides additional braking of the vehicle. The higher the back-pressure is, the more efficient the deceleration is. However, this back-pressure has to be limited to the maximum set-point pressure allowable by the exhaust head, in order to prevent the reopening of the inlet valves. This back-pressure depends of course on the exhaust gas pressure exerted on the shutter which is an asymptotic function of the engine speed. Consequently, there is a level of back-pressure and therefore a deceleration level which corresponds to each engine speed. What is currently being sought is to make this function constant and at most equal to the maximum allowable set-point pressure whatever the engine speed and right from the low speeds, with the aim of optimizing the deceleration.

One of the techniques proposed is described in the publication EP-A-536 284 in which an exhaust modulator device comprises two leak holes closed by spring blades with different rigidities in a shutter. When a first level of back-pressure is reached, a first spring blade opens a first leak hole and releases part of the exhaust gas. When a second level of back-pressure is reached, the second spring blade opens a second leak hole thus increasing the exhaust gas flow rate. This device makes it possible to limit the backpressure but generates deceleration stages. It therefore is not optimum. Furthermore, the spring blades are subject to temperature constraints and to the aggressiveness of the exhaust gas. As a result, the way they operate deteriorates in time, thus affecting their performance when opening and closing. Indeed, under the heat of the exhaust gas, the spring blades become less rigid and the holes will always stay open, thus reducing the back-pressure and the deceleration efficiency.

Another technique is described in the publication CH-A-428 318 and provides for a flap-valve arranged in the body of the butterfly valve on shaft. For this purpose, the body comprises two specific pipes forming a by-pass circuit when the flap is activated. This construction requires a specific housing to be made outside the decelerator to receive the flap and ensure that this housing is tight and lets in no the exhaust gas. However, the flap as it is built does not make it possible to ensure this tightness. Furthermore, this outside housing creates space problems. An additional spring is necessary between the flap and the shutter to keep the latter oriented upwards against an axial stop provided on the drive shaft and avoids the vibrations from said shutter. The configuration of this axial stop makes it necessary to make the body of the decelerator in two parts which also causes tightness problms. Furthermore, no sealing device is provided for around the shutter's drive shaft.

The aim of the present invention is to improve current decelerator devices by proposing a device for balancing the back-pressure which is simple, compact, costs less, and makes it possible to achieve constant and maximum deceleration performances whatever the engines speed whilst ensuring reliability and operating stability in time, without any risk of damage due to the attacks of the exhaust gas and the high temperature.

This aim is achieved by a decelerator device such as defined in the preamble and characterized in that the balancing device is incorporated into the body of the valve and comprises a guide bush crossed by the shaft and provided with an axial housing designed to receive said calibrated flap and its spring coaxial to said shaft and in that the outlet pipe is arranged substantially perpendicular to the shaft and opens into the channel downstream from said shutter so as to create, in association with said balancing device, a circuit for diverting part of the flow of exhaust gas.

In a preferred form of embodiment, the guide bush comprises at least one peripheral orifice communicating with the part downstream from the outlet pipe.

Preferably, the guide bush comprises an annular seat designed to receive said calibrated flap when it abuts, this seat comprising an opening which allows said calibrated flap to communicate with the channel upstream from the shutter.

The annular seat can be made up of a circlip arranged in a corresponding groove provided in said guide bush, the inside diameter of the circlip being greater than that of the shaft and delimiting said opening.

Advantageously, the shutter comprises a cavity arranged opposite the calibrated flap and communicating with the channel upstream from the shutter, when the latter is in the closed position.

In the preferred form of embodiment, the calibrated flap comprises a gasket arranged around the shutter's shaft and in its axial housing the guide bush comprises a ring provided with a gasket which is also arranged around the shutter's shaft, these gaskets being sheet gaskets made of graphite.

Advantageously, the guide bush comprises a base arranged opposite a corresponding face of the shutter to constitute a first axial stop.

The valve also comprises a second guide bush designed to guide the other end of said drive shaft, this second bush comprising a base arranged opposite a corresponding face of the shutter to constitute a second axial stop.

Preferably, the guide bushes have an outside threading, they are screwed into corresponding housings provided in said body and they are treated to offer a low coefficient of friction and withstand high temperatures and the oxidation of the exhaust gas.

Figure 2:
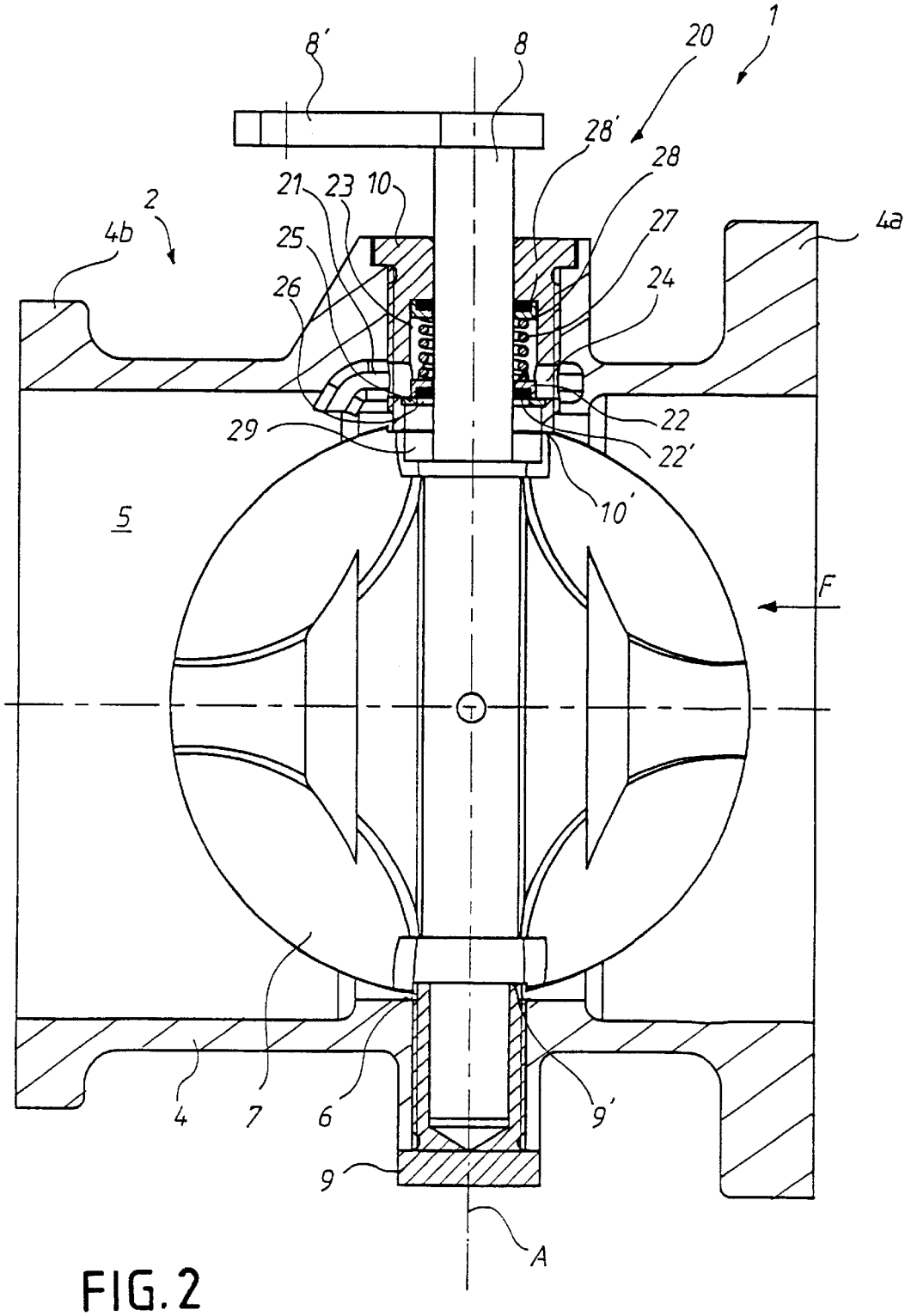
Figure 3:
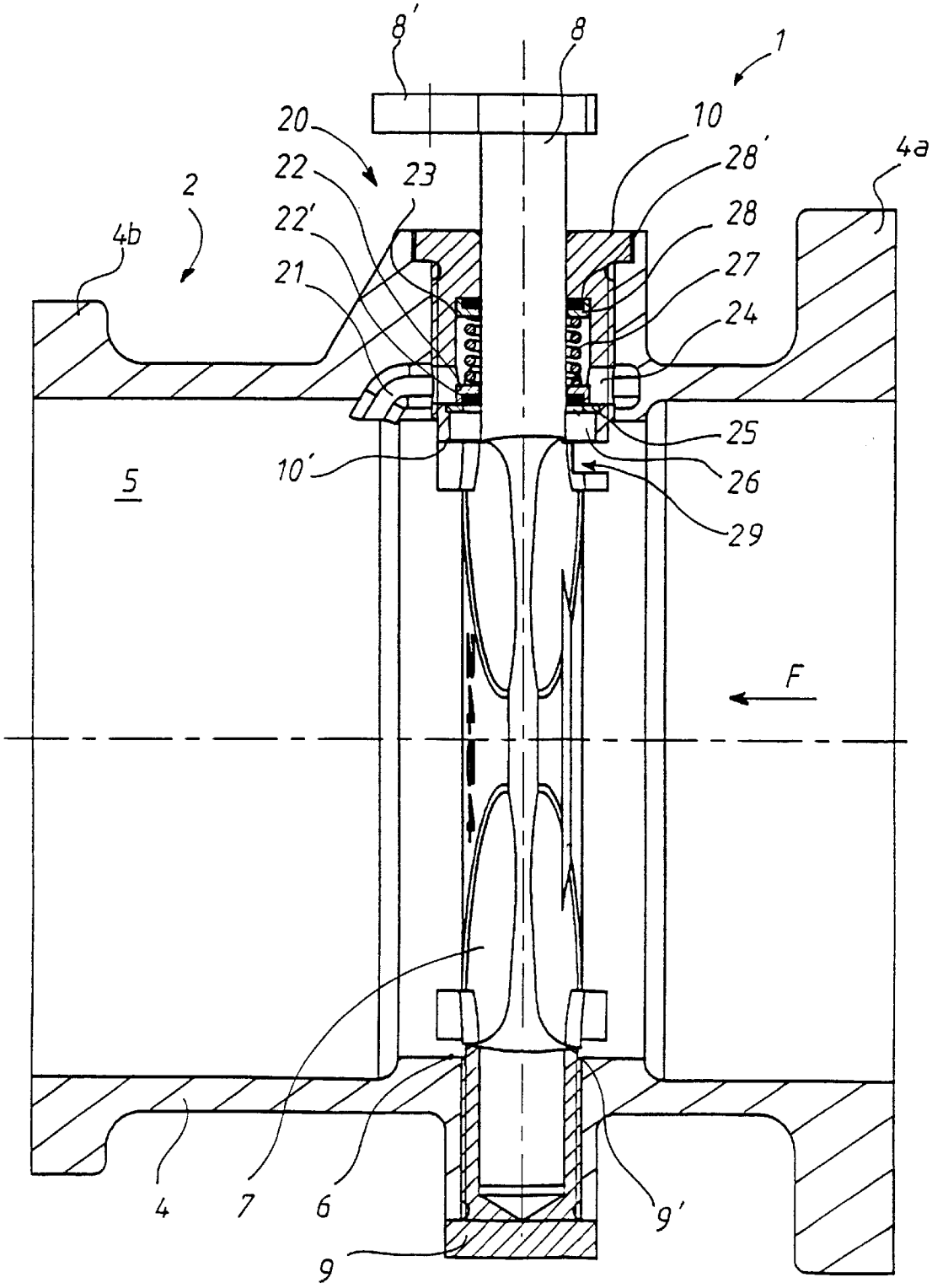
Figure 4:
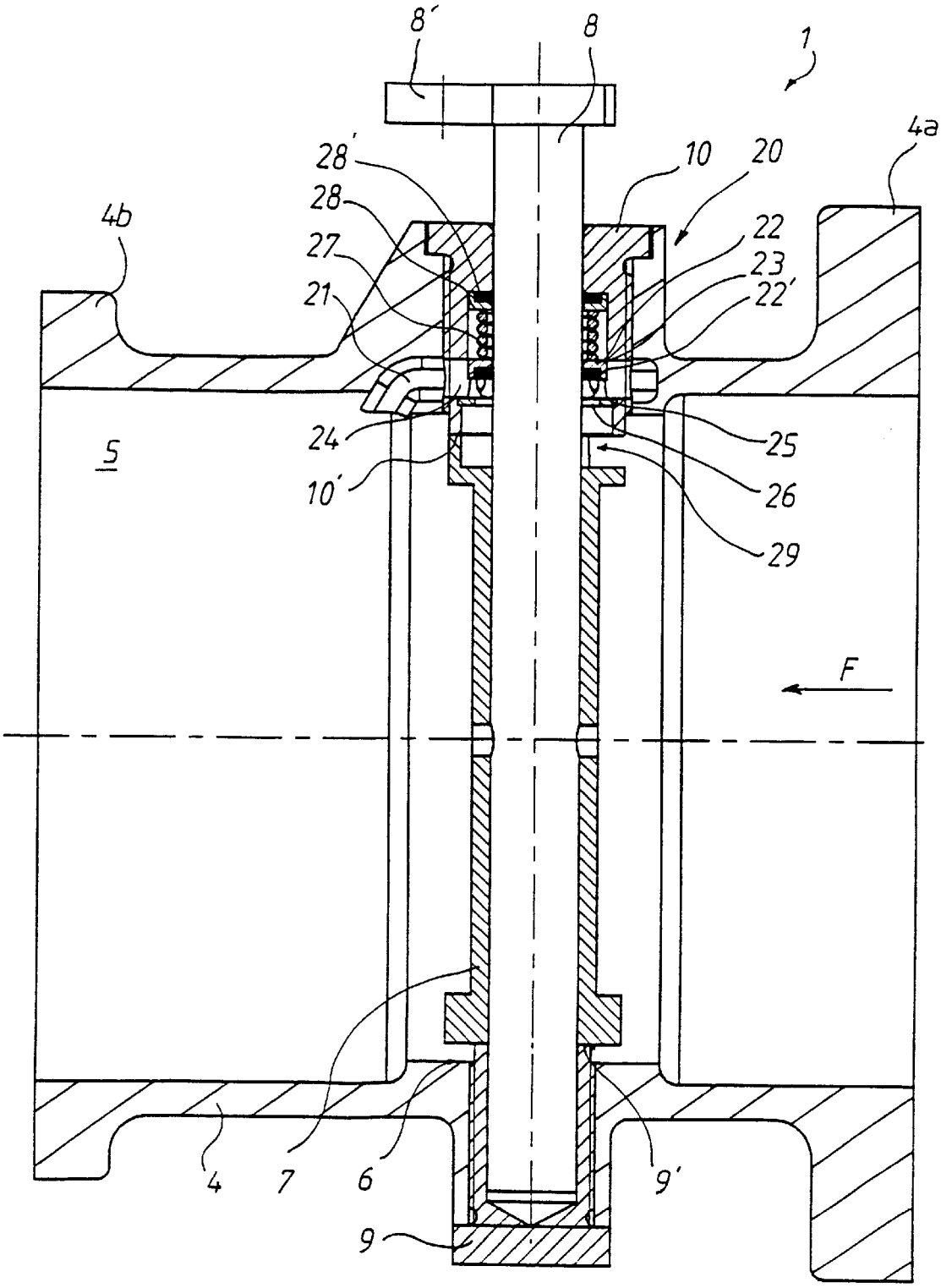
Figure 5:
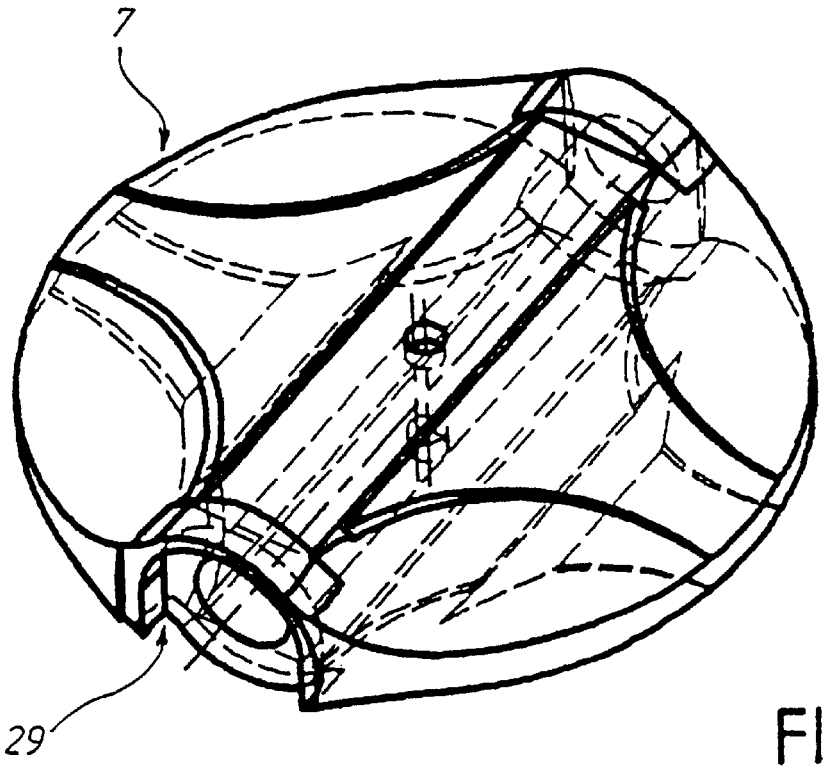
Figure 6:
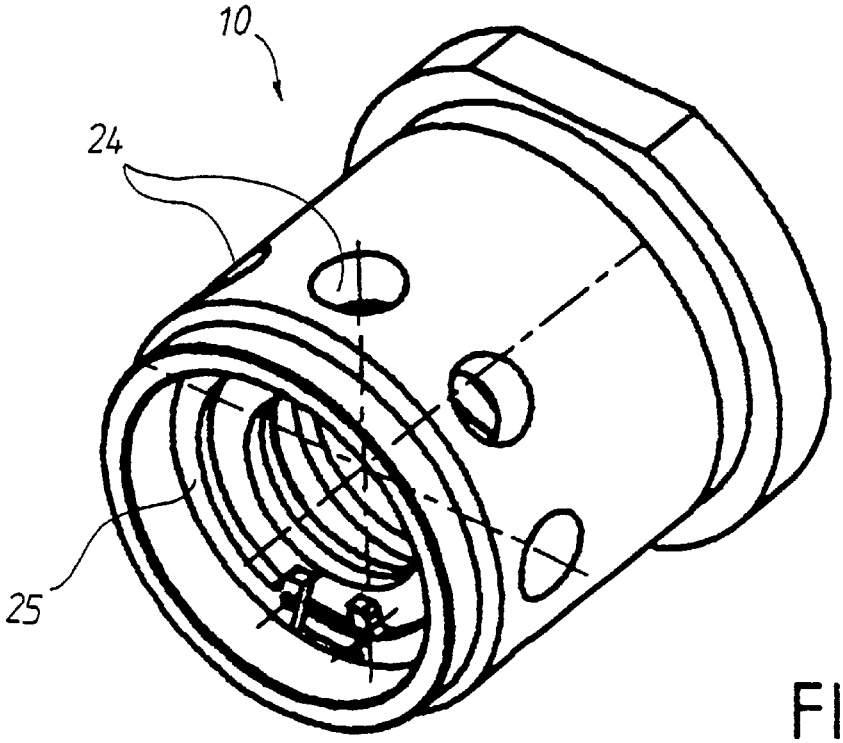

The present invention and its advantages shall be more fully disclosed in following the description of a form of embodiment given by way of an unrestricted example and with reference to the attached drawings, in which:

FIG. 1 represents an overall perspective view of a decelerator device according to the invention mounted on the outlet side of a turbocompressor, FIGS. 2 to 4 are axial cutaway views showing the decelerator device respectively idle - the shutter open, working - the shutter closed and balanced - the outlet pipe open, FIG. 5 is a perspective view of the shutter, FIG. 6 is a perspective view of the guide bush of the balancing device.

With reference to FIG. 1, the decelerator device 1 according to the invention is mounted in the standard way in the exhaust circuit of a vehicle which is generally industrial and equipped with a combustion engine, on the outlet side of a turbocompressor TC fed by an exhaust head EH which recovers the gas from said engine (not shown).

With reference to FIGS. 2 to 4, the decelerator device 1 comprises a valve 2 controlled by suitable control means (not shown), such as a cylinder, a motor, etc. The valve 2 comprises a body 4 defining a channel 5 for the exhaust gas to pass in the direction of the arrows F and a bore 6 for a movable shutter 7 mounted in said body 4 at right angles to said channel 5 designed to retain the gas upstream when it is in the closed position. The body 4 comprises at its ends two mounting flanges 4*a*, 4*b* designed to receive, upstream, a corresponding flange from the turbocompressor TC and, downstream, a corresponding flange from the exhaust pipe (see FIG. 1). Of course, according to the type of decelerator, the mounting flanges 4*a*, 4*b* can be replaced by any other equivalent device such as clamping collars, etc.

The movable shutter 7, which is shown, is a butterfly valve mounted on a shaft 8 with axis A, this shaft 8 defining the axis of rotation of said shutter 7. The shaft 8 is guided to rotate in said body 4 by two guide bushes, one lower 9 and one upper 10. The guide bushes 9, 10 are screwed into the body 4 in their corresponding housings, and being assembled by their threading ensures effective tightness between the bushes and said body in relation to the exhaust gas likely to infiltrate. These bushes 9, 10 also rest axially on corresponding faces of the shutter 7 with their corresponding inside faces 9', 10' and thereby ensure the positioning and the axial locking of said shutter thereby avoiding any risk of parasitic vibration. For this purpose, these bushes 9, 10 are treated to offer a low coefficient of friction and withstand high temperatures and oxidation due to the gas. One of the ends of the shaft 8 crosses said body 4 by way of the upper guide bush 10 to be coupled to drive means directly or by a lever arm 8'. Any other form of shutter can be imagined such as a plug, a ball or a slide valve.

In addition, the deceleration device 1 comprises a balancing device 20 incorporated into said body 4 of the valve 2 and designed to create an outlet flow of exhaust gas when shutter 7 is in the closed position to balance the pressures and obtain a maximum and constant back-pressure value regardless of the engine's speed, when a certain predetermined pressure threshold is reached.

This balancing device 20 comprises an outlet pipe 21 arranged in the body 4 short-circuiting the shutter 7. It is in fact a decompression vault which already exists in the body 4 and is used in the decelerators invented by the holder of the present application to ensure tightness between the drive shaft and the body. In the present invention, this decompression vault is used as an outlet pipe. As a result, the body 4 does not need to undergo any special modifications apart from providing for a housing for the upper guide bush 10.

This outlet pipe 21 is therefore arranged substantially perpendicular to the shaft 8, on either side of the upper guide bush 10. It has a blind end upstream from the shutter 7 and opens into the channel 5 downstream from said shutter 7. This balancing device 20 also comprises a calibrated flap 22 arranged to open or close said outlet pipe 21 when a set pressure threshold is reached. This calibrated flap 22 is annular, mounted slidingly around the shaft 8 and finished by a gasket 22'. This calibrated flap 22 is mounted in an axial housing 23 provided in the upper guide bush 10 and through which the shaft 8 passes. The upper guide bush 10 comprises peripheral orifices 24 communicating with said outlet pipe 21. At its end located near the shutter 7, it also comprises an annular seat 25 designed to receive said calibrated flap 22 and to leave an opening 26 around the shaft 8, allowing the gas to push directly on the calibrated flap 22. As illustrated by FIG. 6, this annular seat 25 can be made up of a circlip housed in a corresponding groove provided in said upper bush 10, its inside diameter being greater than that of the shaft 8 and defining said opening 26. When the calibrated flap 22 is detached from its annular seat 25, this opening 26 allows the channel 5 and the peripheral orifices 24 to communicate. A compression spring 27 is provided at the rear of the calibrated flap 22. It is mounted to abut against a ring 28 fitted with a gasket 28' and resting against the bottom of said axial housing 23. This compression spring 27 is calibrated to a value so that it compressed when a force is applied which corresponds to the predetermined backpressure threshold, this pressure being exerted directly by the exhaust gas. Furthermore, opposite the upper guide bush 10, the shutter 7 comprises a cavity 29 arranged around the shaft 8 communicating with the opening 26 provided in the annular seat 25. This cavity 29 is in the shape of the arc of a circle and only communicates with the channel 5 upstream from the shutter 7, The gaskets 22' and 28' are preferably sheet gaskets in graphite and therefore withstand high temperatures and corrosive gas. They ensure tightness between the shaft 8 and the flap 22 and the upper bush 10.

The decelerator device 1 is controlled by the driver of the industrial vehicle by means of a control pedal. When the vehicle is running normally, the decelerator device 1 is idle, therefore the shutter 7 is open (cf FIG. 2) allowing the gas to escape freely. During breaking, the drive means activated by the user cause the shutter 7 to close (cf FIG. 3) thus retaining the gas and generating a back-pressure which causes the engine to slow down and therefore a reduction in the vehicle's speed. It has to be specified that even in the closed position, there is play between the bore 6 and the shutter 7 to allow a small quantity of exhaust gas to escape, thus avoiding any risk of blocking and excess pressure which is dangerous for the equipment located upstream. When a certain pressure threshold is reached, the balancing device 20 (cf FIG. 4) is activated to balance the pressures and regulate the back-pressure to a constant value whatever the engine's speed.

FIG. 2 shows the deceleration device 1 in its idle position. The shutter 7 is in the open position, i.e. directed parallel to the flow of the exhaust gas. The pressure of the gas in front of the calibrated flap 22 is substantially null. As a result, the balancing device 20 is not in action.

FIG. 3 shows the decelerator device 1 in its working position. The shutter 7 is in the closed position i.e. oriented perpendicular to the flow of exhaust gas and generates the back-pressure. As explained above, the shutter 7 and this shutter's bore 6 are designed to allow a very small amount of gas to escape. In this Figure, the pressure in front of the calibrated flap 22 increases but is still lower than the predetermined back-pressure threshold defined by the compression spring 27.

FIG. 4 shows the decelerator device 1 in its balanced position. The pressure of the gas upstream from the shutter 7 has risen beyond the back-pressure threshold determined by the spring 27 of the calibrated flap 22. Under the effect of this pressure, the calibrated flap (22) is lifted from its seat (25), compressing the spring 27. The opening 26 then allows the channel 5 upstream from the shutter 7 via its cavity 29 to communicate with the outlet pipe 21 via peripheral orifices 24 arranged in the upper guide bush 10. Part of the exhaust gas is therefore diverted into the outlet pipe 21 which evacuates it downstream from the shutter 7 creating a varying outlet flow to maintain a substantially constant back-pressure. In this configuration of the decelerator device 1, the calibrated flap 22 remains open in a balanced position which has the effect of regulating the back-pressure upstream from the shutter 7. A constant and maximum deceleration is achieved corresponding for example to the maximum set-point pressure allowed by the exhaust head CE, whatever the engine's speed.

It clearly emerges from this description that the invention makes it possible to improve current decelerator devices by proposing a balancing device 20 which is simple, inexpensive, effective, compact and incorporated into the valve 2, also ensuring good tightness of the decelerator.

The present invention is not limited to the example of embodiment described but can be widened to include any modification or alternative, which is obvious for the expert.

What is claimed is:

1. A decelerator device (1) mounted in an exhaust gas circuit of a vehicle equipped with a combustion engine, comprising at least one valve (2) provided with a body (4) defining a channel (5) and a movable shutter (7) arranged in said channel (5) and coupled to a drive shaft (8), and means of controlling the shutter comprising a balancing device (20) for balancing back-pressure exerted by the shutter on the gas, the balancing device being designed to operate when the shutter (7) is in a closed position and when a predetermined back-pressure threshold is reached and to open an outlet pipe (21) as soon as the back-pressure reaches said threshold and to keep the outlet pipe (21) open above said threshold, regardless of a speed of the engine, in order to create a suitable exhaust gas leak flow rate, the balancing device (20) comprising a calibrated flap (22) arranged in said outlet pipe (21) and a compression spring (27) biasing a rear surface of said calibrated flap (22), the spring being calibrated to said threshold value, wherein the balancing device (20) is incorporated into the body (4) of the valve (2) and comprises a guide bush (10) supporting the shaft (8) and provided with an axial housing (23) designed to receive said calibrated flap (22) and the spring (27) coaxial with said shaft (8) and the outlet pipe (21) is arranged substantially perpendicular to the shaft (8) and opens into the channel (5) downstream from said shutter so as to create, in association with said balancing device (20), a circuit for diverting part of the exhaust gas flow.

2. The decelerator device according to claim 1, wherein the guide bush (10) comprises at least one peripheral orifice (24) communicating downstream of the outlet pipe (21).

3. The decelerator device according to claim 1, wherein the guide bush (10) comprises an annular seat (25) arranged to receive said calibrated flap (22) when said calibrated flap (22) closes said outlet pipe (21), the annular seat comprising an opening (26) allowing said calibrated flap (22) and the channel (5) upstream from the shutter (7) to communicate.

4. The decelerator device according to claim 3, wherein the annular seat (25) is a circlip arranged in a corresponding grove provided in said guide bush (10), and an inside diameter of the circlip is greater than that of the shaft (8) and delimiting said opening (26).

5. The decelerator device according to claim 1, wherein the shutter (7) comprises a cavity (29) arranged opposite the calibrated flap (22) and communicating with the channel (5) upstream from the shutter (7), when the shutter (7) is in the closed position.

6. The decelerator device according to claim 1, wherein the calibrated flap (22) comprises a gasket (22') arranged around the shaft (8) adjacent the shutter (7).

7. The decelerator device according to claim 1, wherein the guide bush (10) comprises, in an axial housing (23) of the guide bush (10) a ring (28) provided with a gasket (28') arranged around the shaft (8).

8. The decelerator device according to claim 6 wherein the gasket (22' or 28') is a sheet of graphite.

9. The decelerator device according to claim 1, wherein the guide bush (10) comprises a face (10') arranged opposite a corresponding face of the shutter (7) to form a first axial stop.

10. The decelerator device according to claim 9, wherein the valve (2) comprises a second guide bush (9) arranged to guide a second end of said drive shaft (8), the second bush comprising a face (9') opposite a corresponding face of the shutter (7) to form a second axial stop.

11. The decelerator device according to claim 9, wherein the guide bush (9 or 10) has a threading and the guide bush (9 or 10) is screwed into a corresponding opening provided in said body (4).

12. The decelerator device according to claim 11, wherein the guide bush (9 or 10) is treated so as to have low coefficient of friction and withstand high temperatures and oxidation of the exhaust gas.

13. A decelerator device (1) mounted in an exhaust gas circuit of a vehicle equipped with a combustion engine, the decelerator device (1) comprising at least one valve (2) provided with a body (4) defining a channel (5) and a movable shutter (7) arranged in said channel (5) and coupled to a drive shaft (8), and a mechanism for controlling the shutter comprising a balancing device (20) for balancing back-pressure exerted by the shutter (7) on the gas, the balancing device operating when the shutter (7) is in a closed position and once a predetermined back-pressure threshold is reached to open an outlet pipe (21) as soon as the back-pressure reaches said threshold and to keep the outlet pipe (21) open above said threshold, regardless of a speed of the engine, so as create a suitable exhaust gas leak flow, the balancing device (20) comprising a calibrated flap (22) arranged in said outlet pipe (21) and a compression spring (27) spring biasing a rear surface of said calibrated flap (22), and the spring being calibrated to said threshold value;

wherein the balancing device (20) is incorporated into the body (4) of the valve (2) and comprises a guide bush (10) supporting the shaft (8) and provided with an axial housing (23) receiving said calibrated flap (22), the compression spring (27) is coaxial with said shaft (8), and the outlet pipe (21) is arranged adjacent the shaft (8) and communicates with the channel (5), downstream from said shutter, so as to create, in association with said balancing device (20), a circuit for diverting a portion of the exhaust gas flow past the shutter (7).

14. The decelerator device according to claim 13, wherein the guide bush (10) comprises at least one peripheral orifice (24) communicating downstream of the outlet pipe (21).

15. The decelerator device according to claim 13, wherein the guide bush (10) comprises an annular seat (25) arranged to receive said calibrated flap (22) when said calibrated flap (22) closes said outlet pipe (21), and the annular seat comprises an opening (26) allowing communication of said calibrated flap (22) and the channel (5) upstream from the shutter (7).

16. The decelerator device according to claim 15, wherein the annular seat (25) is a circlip arranged in a corresponding groove provided in said guide bush (10), and an inside diameter of the circlip is greater than a diameter of the shaft (8) delimiting said opening (26).

17. The decelerator device according to claim 13, wherein the shutter (7) comprises a cavity (29) arranged opposite the calibrated flap (22) and communicating with the channel (5) upstream from the shutter (7), when the shutter (7) is in the closed position.

18. The decelerator device according to claim 13, wherein the calibrated flap (22) comprises a gasket (22') arranged around the shaft (8) adjacent the shutter (7).

19. The decelerator device according to claim 18, wherein the gasket (22' or 28') is a sheet of graphite.

20. The decelerator device according to claim 13, wherein the guide bush (10) comprises, in an axial housing (23) of the guide bush (10), a ring (28) provided with a gasket (28') arranged around the shaft (8).

* * * * *